US008091443B2

(12) United States Patent
Niimi

(10) Patent No.: US 8,091,443 B2
(45) Date of Patent: Jan. 10, 2012

(54) SPEED REDUCTION TYPE STARTER FOR ENGINES

(75) Inventor: Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 840 days.

(21) Appl. No.: 12/216,431

(22) Filed: Jul. 3, 2008

(65) Prior Publication Data

US 2009/0007722 A1 Jan. 8, 2009

(30) Foreign Application Priority Data

Jul. 5, 2007 (JP) ..... 2007-177240

(51) Int. Cl.
*F02N 15/04* (2006.01)

(52) U.S. Cl. ..... 74/7 E; 475/290

(58) Field of Classification Search ..... 74/7 E; 475/149, 150, 290, 317

See application file for complete search history.

(56) References Cited

U.S. PATENT DOCUMENTS

| | | | | |
|---|---|---|---|---|
| 4,912,993 | A * | 4/1990 | Konishi et al. | 74/7 E |
| 5,231,307 | A * | 7/1993 | Yumiyama et al. | 290/48 |
| 5,482,512 | A * | 1/1996 | Stevenson | 475/5 |
| 6,409,622 | B1 | 6/2002 | Bolz et al. | |
| 2004/0093967 | A1 * | 5/2004 | Shiga et al. | 74/7 E |

FOREIGN PATENT DOCUMENTS

| | | |
|---|---|---|
| EP | 0 582 429 A1 | 2/1994 |
| JP | A-61-028756 | 2/1986 |
| JP | A-61-236951 | 10/1986 |
| JP | A-61-282650 | 12/1986 |
| JP | 63101545 A * | 5/1988 |
| JP | A-2-195066 | 8/1990 |
| JP | A-2002-530570 | 9/2002 |

OTHER PUBLICATIONS

Notification of Reasons for Rejection for corresponding Japanese Patent Application No. 2007-177240, mailed on Feb. 1, 2011 (w/ English translation).

European Search Report for European Application No. 08012133.8, mailed on Apr. 15, 2010.

* cited by examiner

*Primary Examiner* — Richard W Ridley
*Assistant Examiner* — Terence Boes
(74) *Attorney, Agent, or Firm* — Oliff & Berridge, PLC

(57) ABSTRACT

The speed reduction type starter for engines comprises the engaging part 34 arranged in the perimeter of two internal gears 25 and 29 used for a set of speed reducers coaxially, the magnetic coil 35 that drives the engaging part 34 to the direction of the anti-motor side, and the return spring 37 that pushes the engaging part 34 to the direction of the motor side When the magnetic coil 35 is in the OFF state, the engaging part 34 is pushed to the motor side by the return spring 37 to engage with the 1st internal gear 25 mechanically, so that the rotation of the 1st internal gear 25 is regulated and the 1st reduction ratio is selected.

On the other hand, when the magnetic coil 35 is in the state of ON, the engaging part 34 is moved to the anti-motor side to engage with the 2nd internal gear 29, so that the rotation of the 2nd internal gear 29 is regulated and the 2nd reduction ratio is selected.

10 Claims, 6 Drawing Sheets

SPEED REDUCTION TYPE STARTER FOR ENGINES

CROSS-REFERENCE TO RELATED APPLICATION

This application is based on and claims the benefit of priority from earlier Japanese Patent Application No. 2007-177240 filed on Jul. 5, 2007, the description of which is incorporated herein by reference.

BACKGROUND OF THE INVENTION

1. Technical field of the Invention

The present invention relates to a speed reduction type starter for engines having two sets of planetary speed reducer.

2. Description of the Related Art

A starter for engines has been known, which is provided with a planetary speed reducer that slows down the speed of a motor, and a reduction ratio of this speed reducer is fixed to a single step (i.e., the reduction ratio cannot be changed) as disclosed in Japanese Patent Application Laid-Open Publication No. 61-28756, for example.

The single step reduction ratio is commonly decided from the required torque of the starter in the lowest usable temperature conditions (in general, −20 degrees centigrade or less) when the friction of an engine becomes the largest. For this reason, when starting the motor at a normal temperature at which the friction of the engine becomes smaller, the required torque of the motor is smaller as well. Since an operating point on a performance curve of the motor moves to less load side and the output declines, the motor speed does not go up greatly On the other hand, the time required for starting the engine depends on the starting speed of the starter, and the starting time can be shortened with the higher motor speed. If the starting speed of starter becomes high, the body vibration at the time of starting the engine decreases. Thus a driver's comfort will improve, and it can contribute to exhaust gas reduction as well. In order to raise the starting speed of the starter at normal temperatures, it is effective to lower the reduction ratio of the speed reducer from that of the low temperature. That is, reduction ratio is set to two steps and it can attain by changing the reduction ratio for normal temperature and low temperature.

There are examples of the means for changing the reduction ratio into two steps disclosed in Japanese Patent Application Laid-Open Publications No. 61-236951 and No. 61-282650.

However, the conventional speed reducer disclosed in Publication No. 61-28756 becomes large in its size because it has many parts and its structure is complicated, therefore it is difficult to apply to the conventional speed reducer that requires miniaturization. Further, when the reduction ratio is low (reduction ratio=1; an input shaft and an output shaft are the same speed), and high (reduction ratio=n; however, $10<n<1$), the low reduction ratio=1 is not suitable for starting the motor at the normal temperature because the torque of the starter is insufficient.

On the other hand, for changing the reduction ratio of the planetary gears having two steps of different reduction ratios, a method of putting brakes on an internal gear of the planetary gears in order to fix the internal gear by tightening a brake band around the perimeter of the internal gear is disclosed in the Publication No. 61-236951.

However, two brake bands are required in order to apply and release brakes to two internal gears, and it is not clear how the two brake bands are operated. Moreover, the drive means for operating the brake bands is not disclosed either; therefore, applying the above method to the starter is difficult.

SUMMARY OF THE INVENTION

The present invention has been made in order to solve the issue described above, and has as its object to provide a starter that secures good engine starting characteristics at low temperature, and can shorten the starting time of the engine at normal temperatures.

In the speed reduction type starter for engines according to a first aspect, a speed reduction type starter for engines comprising an electric motor having an armature shaft, a set of planetary speed reducers having a different reduction ratios disposed on the armature shaft side-by-side, wherein one of the speed reducers is selected in order to reduce a revolving speed of the motor, a pair of internal gears used in the set of planetary speed reducers, and an engaging part arranged coaxially on a perimeter of the pair of internal gears, wherein the engaging part is arranged unrotatably to a fixed member inside the starter and arranged movably along a direction of an axis, and engages mechanically to the one of the internal gears in order to regulate the rotation of the internal gear, wherein the reduction ratio is selected by switching the internal gears by moving the engaging part along the direction of the axis.

According to the present invention, moving the engaging part arranged in the perimeter of the two internal gears coaxially in the direction of an axle so that the one of the internal gears mechanically engages to the engaging part can regulate the rotation of one of the internal gears. Consequently, by changing the internal gear with which rotation is regulated alternatively according to the operating condition (out side air temperature, for example) of the starter etc., low reduction ratio and high reduction ratio can be properly used.

In addition, the internal gear that the rotation is regulated and the internal gear that the rotation is permitted can easily be switched by moving the engaging part in the direction of the axle. Since the rotation of one internal gear is regulated when the rotation of the other internal gear is permitted and the rotation of one internal gear is permitted when the other internal gear is regulated, regulating and permitting of the rotation of two internal gears can be performed with a simple composition and less parts.

In the speed reduction type starter for engines according to a second aspect, the starter further comprises a concavo-convex part formed in the perimeter of the 1st internal gear of the pair of internal gears arranged on the direction of the anti-motor side, another concavo-convex part formed in the perimeter of the 2nd internal gear of the pair of internal gears arranged on the direction of the motor side, a 1st concavo-convex part engageable with the concavo-convex part formed in the 1st internal gear, and a 2nd concavo-convex part engageable with the concavo-convex part formed in the 2nd internal gear formed in the inner circumference of the engaging part, wherein the rotation of the 1st internal gear is regulated when the 1st concavo-convex part engages with the concavo-convex part of the 1st internal gear by moving the engaging part to the direction of motor side, and the rotation of the 2nd internal gear is regulated when the 2nd concavo-convex part engages with the concavo-convex part of the 2nd internal gear by moving the engaging part to the direction of anti-motor side.

In the speed reduction type starter for engines according to a third aspect, the 1st concavo-convex part and the 2nd concavo-convex part are arranged as a unit in the direction of the axis continuously.

In the speed reduction type starter for engines according to a fourth aspect, end surfaces of the pair of internal gears facing each other in the direction of the axis are engaged rotatably in concavo-convex manner.

In the speed reduction type starter for engines according to a fifth aspect, resin material is used for at least one of the internal gears.

In the speed reduction type starter for engines according to a sixth aspect, the starter further comprises an magnetic coil that forms an electromagnet by energization and drives the engaging part to one direction by the magnetic force of the electromagnet, a return spring that pushes back the engaging part to another direction when the energization to the magnetic coil is stopped, the 1st internal gear arranged on the direction of the motor side, and the 2nd internal gear arranged on the direction of the anti-motor side, wherein the magnetic coil is arranged close to either the motor side of the 1st internal gear or the anti-motor side of the 2nd internal gear.

In the speed reduction type starter for engines according to a seventh aspect, a ferromagnetic substance attracted by the electromagnet constitutes the engaging part.

In the speed reduction type starter for engines according to a eighth aspect, the starter further comprises, a fixed yoke that lets magnetic flux generated by the magnetic coil pass through, wherein the fixed yoke has a ring-like magnetic path part that is arranged between the magnetic coil and one of the pair of the internal gears, and the engaging part having a cylinder iron core part that is extended in the direction of the axle on the perimeter of the ring-like magnetic path part, wherein an inner circumference of the cylinder iron core part engages in concavo-convex manner to the ring-like magnetic path part so that the rotation in the direction of a circumference of the engaging part is regulated, while a movement in the direction of axis is permitted.

In the speed reduction type starter for engines according to a ninth aspect, the engaging part regulates the rotation of the internal gear used for the speed reducer with the low reduction ratio when the magnetic coil is not energized, and the engaging part regulates the rotation of the internal gear used for the speed reducer with the high reduction ratio when the magnetic coil is energized.

In the speed reduction type starter for engines according to a tenth aspect, the engaging part regulates the rotation of the internal gear used for the frequently used speed reducer when the magnetic coil is not energized, and the engaging part regulates the rotation of the internal gear used for the not frequently used speed reducer when the magnetic coil is energized.

In the speed reduction type starter for engines according to an eleventh aspect, the magnetic coil is not energized when the out side air temperature is higher than 0 degree centigrade, and the magnetic coil is energized when the out side air temperature is 0 degree centigrade or less.

DETAILED DESCRIPTION OF THE PREFERRED EMBODIMENTS

With reference to the accompanying drawings, hereinafter will be described an embodiment of the present invention.

Figure 1:
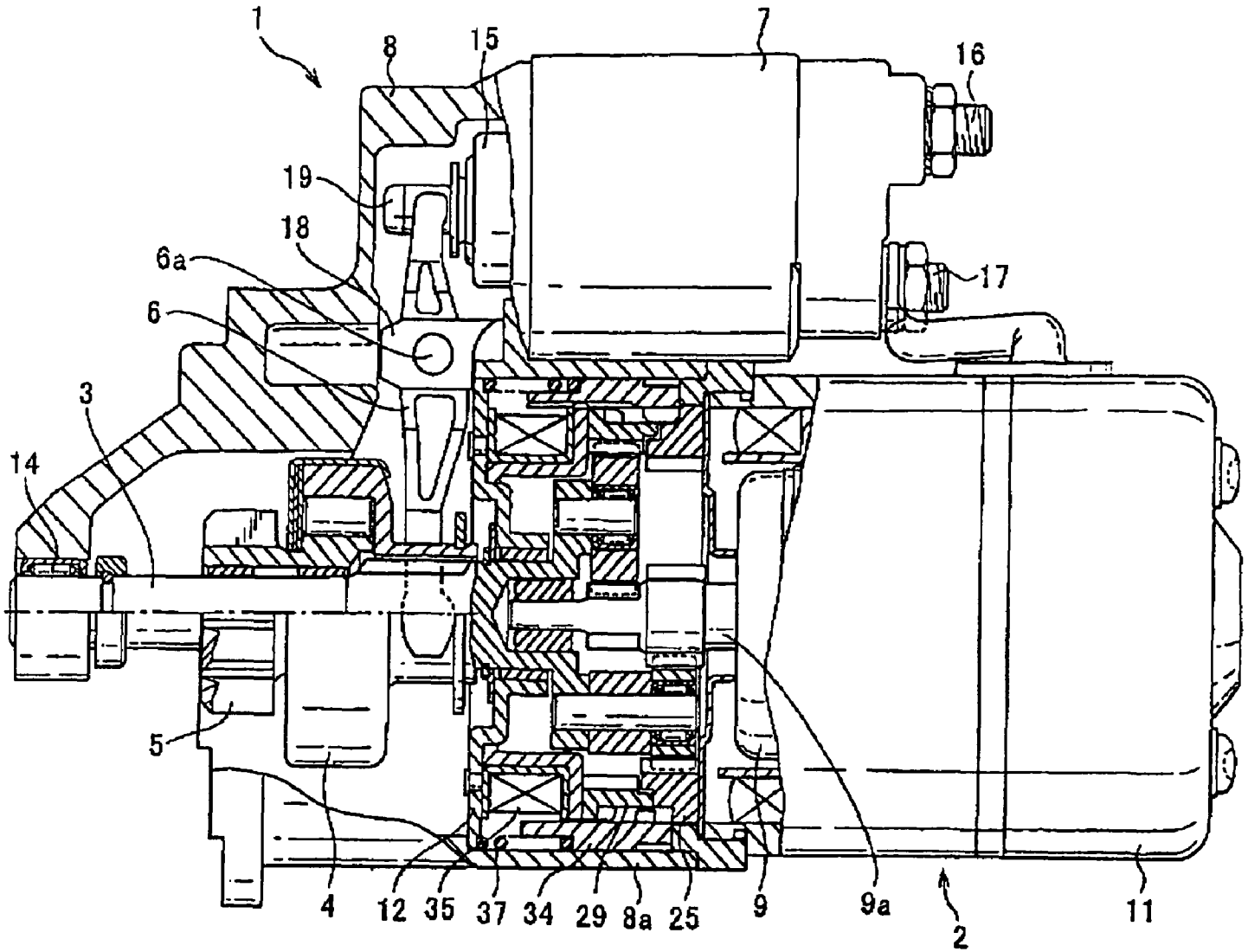
FIG. 1 is a fragmentary sectional view of a starter.

FIG. 1 shows a half cross-sectional view of a starter 1. As shown in FIG. 1, the starter 1 of this embodiment generally comprises an electric motor 2, a speed reducer (described later), a switching device (described later), a pinion gear 5, an electromagnetic switch 7, and a front housing 8. The electric motor 2 generates a rotational force. The speed reducer has two steps of speed, which transmits the rotational speed of the electric motor 2 to an output shaft 3 after the rotational speed of the electric motor 2 is reduced. The switching device switches a reduction ratio of the speed reducer. The pinion gear 5 is arranged on the perimeter of the output shaft 3 together with a clutch 4 as a unit. The electromagnetic switch 7 opens and closes a main point of contact (not shown) provided in an energization circuit of the electric motor 2, and moves the unit of the clutch 4 and the pinion gear 5 in the direction of an axle via a shift lever 6. The front housing 8 is fixed to the engine side.

The electric motor 2 is a commonly known commutator motor. The electric motor 2 has a commutator and brushes (not shown) for changing a current energized to an armature 9 according to a rotation phase. The armature 9 has an armature shaft 9*a* that outputs the torque. The armature shaft 9*a* has a first end on the anti-commutator side (left end in FIG. 1) that is inserted rotatably into an inner circumference of a space drilled in the motor side edge part of the output shaft 3 via a bearing 10. Another bearing (not shown), which is fixed to an end frame 11, rotatably supports the second end (right end in FIG. 1) of the armature shaft 9*a*.

The output shaft 3 is disposed in coaxial relation to the armature shaft 9*a*. The output shaft 3 has one end (right end in FIG. 1) supported rotatably by a bearing 13 that is fixed to an inner side of a frame member 12. A bearing 14, which is fixed to the front tip part of the front housing 8, rotatably supports the opposite end (left end in FIG. 1) of the output shaft 3. A frame member 12 is fit into the inner circumference of cylinder wall part 8*a* provided in the front housing 8, and is fixed so that the frame member 12 is supported unrotatably in the direction of a circumference.

The clutch 4 is provided on the perimeter of the output shaft 3 via helical spline engagement that transmits a rotation of the output shaft 3 to the pinion gear 5 at the time of starting the engine. When the pinion gear 5 is rotated by the engine, that is, when the revolving speed of the pinion gear 5 exceeds the revolving speed of the output shaft 3, the clutch 4 acts as a one-way clutch that intercepts the power transfer between both the pinion gear 5 and the output shaft 3 so that the rotation of the pinion gear 5 is not transferred to the output shaft 3.

After the pinion gear 5 is engaged to a ring gear (not shown) of the engine, the pinion gear 5 transmits the torque via a clutch 4 to drive the ring gear.

The electromagnetic switch 7 has a switch coil (not shown) and a plunger 15. The switch coil is energized from a battery by closing a starting switch (not shown), and the plunger 15 that moves inside the inner circumference of the switch coil. When an electromagnet is formed by the energization to the switch coil, the plunger 15 will be attracted by the electromagnet and closes the main point of contact. On the other hand, when the attracting force is removed by stopping the energization to the switch coil, the plunger 15 is pushed back to its original position by the force of the return spring (not shown) and opens the main point of contact.

The main point of contact is comprised of a pair of fixed contacts (not shown) connected to a motor circuit via two external terminals 16 and 17 that are disposed on the electromagnetic switch 7, and a movable contact (not shown) that connects and disconnects the pair of fixed contacts, which is disposed on the movable plunger 15. The main point of contact is in a closed state when the pair of fixed contacts is electrically connected via the movable contact, and the main point of contact is in a closed state when the pair of fixed contacts is electrically disconnected.

The shift lever 6 has a supporting part 6*a*, which is supported swingably by a lever holder 18. The shift lever 6 has a function of transmitting a motion of the plunger 15 to the clutch 4 by engaging one end of the shift lever 6 to a shifting rod 19 disposed on the plunger 15 of the electromagnetic switch 7, and by engaging another end of the shift lever 6 to the clutch 4.

The speed reducer is explained hereafter.

Figure 2:
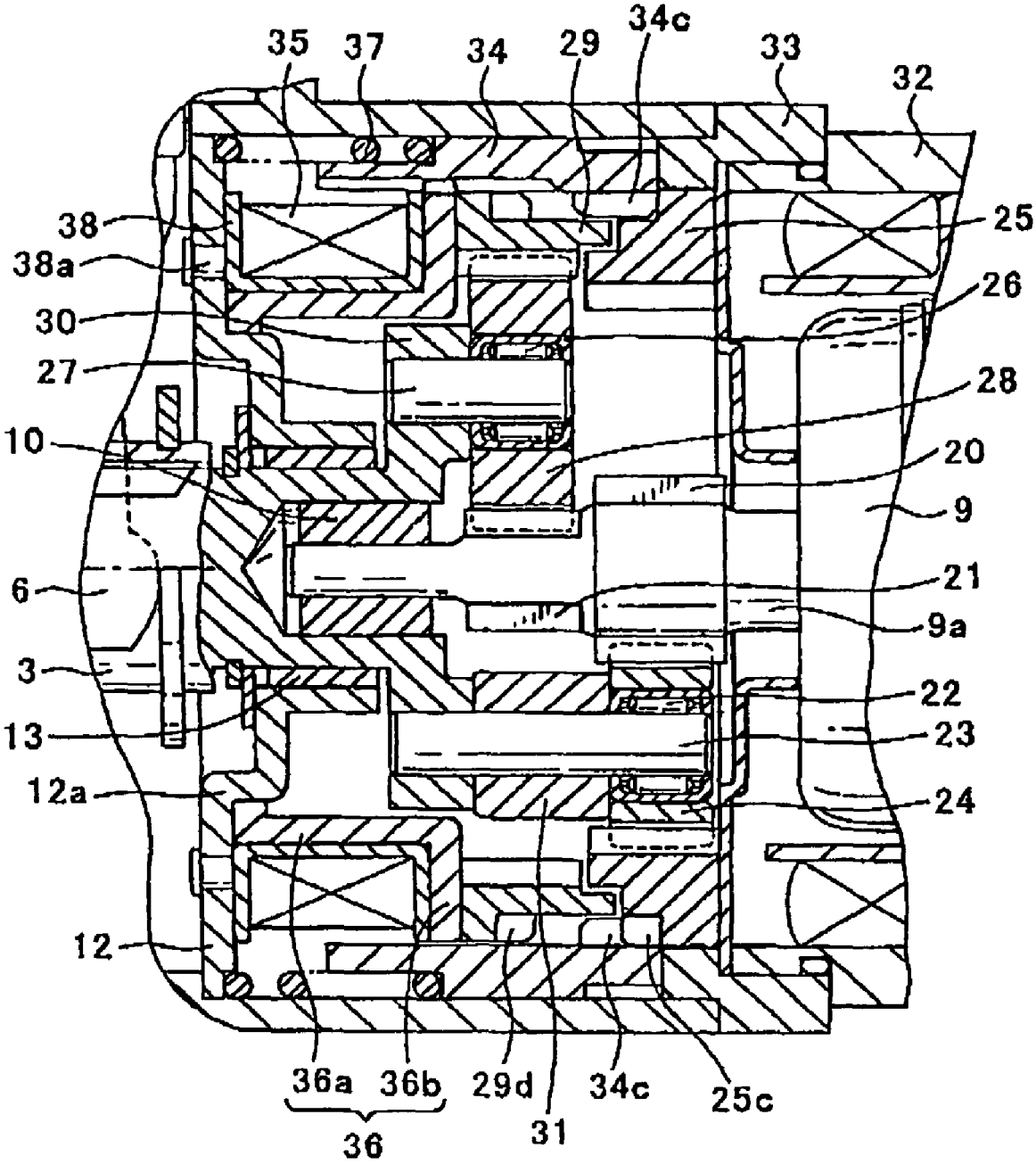
FIG. 2 is a sectional view of a speed reducer and a switching device (a coil is OFF)

As shown in FIG. 2, the speed reducer is comprised of a 1st planetary speed reducer (shortened to "1st speed reducer" hereafter) and a 2nd planetary speed reducer (shortened to "2nd speed reducer" hereafter). The 1st speed reducer is constituted of having a 1st sun gear 20 formed on the armature shaft 9*a* in the center as well as the 2nd speed reducer is constituted of having a 2nd sun gear 21 formed on the armature shaft 9*a* in the center. Here, when calling a reduction ratio set for the 1st reduction ratio is 1st reduction ratio and a reduction ratio set for the 2nd speed reducer is 2nd reduction ratio, the 2nd reduction ratio is set larger than the 1st reduction ratio.

As for the 1st sun gear 20 and the 2nd sun gear 21, the 2nd sun gear 21 is formed on the tip side (left-hand side of FIG. 2) of the armature shaft 9*a* than the 1st sun gear 20. A teeth tip diameter of the 1st sun gear 20 is larger than that of the 2nd sun gear 21, and the 1st sun gear 20 is provided with more teeth than the 2nd sun gear.

Pluralities of 1st planetary gears 24 are engaged to the perimeter of the first sun gear 20. Planet pins 23 rotatably support the 1st planetary gears 24 via bearings 22. The 1st planetary gears 24 are engaged also to the inner circumference of a 1st internal gear 25 that is located coaxially with the 1st sun gear 20.

Similarly, pluralities of 2nd planet gear 28 are engaged to the perimeter of the 2nd sun gear 21. Planet pins 27 rotatably support the 2nd planetary gears 2B via bearings 26. The 2nd planetary gears 28 are engaged also to the inner circumference of a 2nd internal gear 29 that is provided coaxially with the 2nd sun gear 21.

The planet pins 23 and 27 are fixed to a planet carrier 30 provided in the output shaft 3. The planet pins 23 and the planet pins 27 are arranged alternately in the direction of a circumference of the planet carrier 30. A spacer member 31 is inserted to the planet pins 23 in between the planet carrier 30 and the 1st planet gear 24. The spacer member 31 regulates the 1st planet gear 24 from moving toward the direction of the anti-motor side (the planet carrier 30 side).

Figure 4:
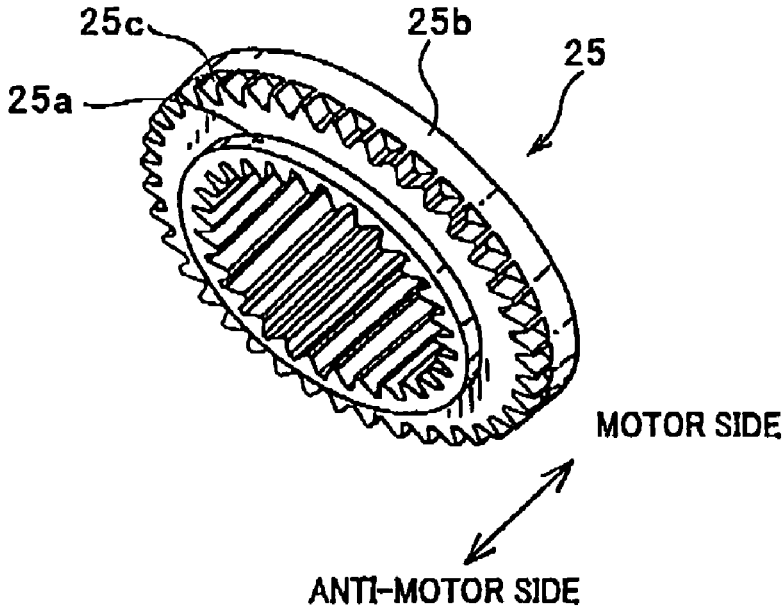
FIG. 4 is a perspective diagram of a 1st internal gear.

As shown in FIG. 4, the 1st internal gear 25 is provided with an annular convex part 25*a* on the anti-motor side of the 1st internal gear 25. A large diameter part 25*b* with a larger outer diameter than the annular convex part 25*a* is provided on the motor side of the annular convex part 25*a* on the 1st internal gear 25. Further, pluralities of teeth part 25*c* are formed in all circumferences of the perimeter of the anti-motor side of the large diameter part 25*b*. As shown in FIG. 2, the large diameter part 25*b* is provided coaxially with the armature shaft 9*a*, and engages rotatably to the inner circumference of the joint member 33 that is pinched between a yoke 32 of the electric motor 2, and the cylinder wall part 8*a* of the front housing 8.

Figure 5:
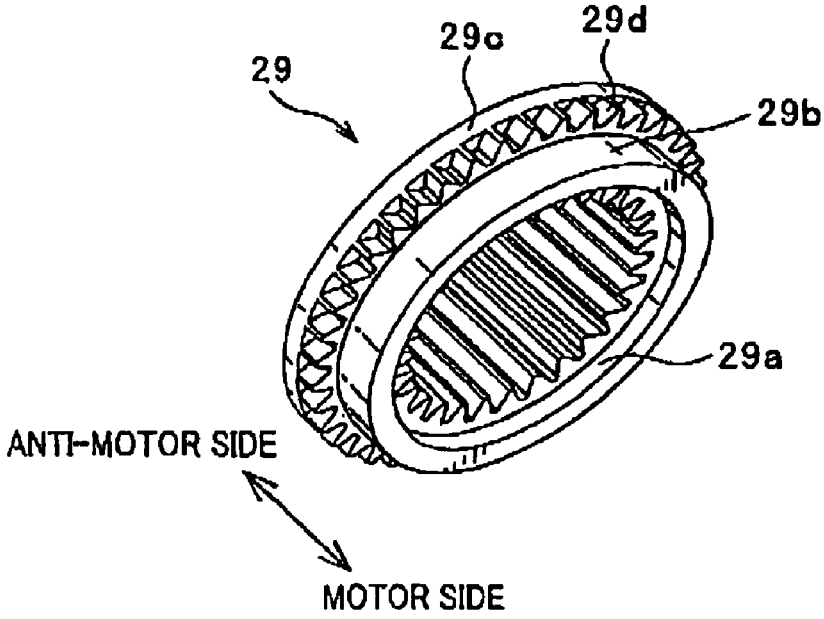
FIG. 5 is a perspective diagram of a 2nd internal gear.

The 2nd internal gear 29 has an inner diameter larger than the 1st internal gear 25, and has a higher number of teeth. As shown in FIG. 5, the 2nd internal gear 29 is provided with an annular concave part 29*a* formed on the motor side of the 2nd internal gear 29 with the inner diameter larger than the diameter of teeth bottom of the 2nd internal gear 29. The annular concave part 29*a* and the annular convex part 25*a* provided in the 1st internal gear 25 are rotatably in concavo-convex manner (refer to FIG. 2). The 2nd internal gear 29 has two sizes of outer diameters. There provided are a small diameter part 29*b* on the motor side and a large diameter part 29*c* on the anti-motor side of the 2nd internal gear 29. Pluralities of teeth part 29*d* are formed on all circumferences of the motor side of the large diameter part 29*c*. The teeth part 29*d* formed on the large diameter part 29*c* has the same number of teeth with the teeth part 25*c* formed on the large diameter part 25*b* of the 1st internal gear 25, and the diameters of the teeth bottom and teeth tip of the both the teeth part 25*c* and the teeth part 29*d* are set as the same.

Next, the switching device is explained hereafter.

As shown in FIG. 2, the switching device is equipped with an engaging part 34, a magnetic coil 35, a fixed yoke 36, and a return spring 37. The engaging part 34 engages mechanically with one of the 1st internal gear 25 and the 2nd internal gear 29. The magnetic coil 35 forms an electromagnet by energization and drives the engaging part 34 to the direction of anti-motor side by the attracting force of the electromagnet. The fixed yoke 36 lets the magnetic flux generated by the magnetic coil 35 pass through. The return spring 37 pushes back the engaging part 34 to the direction of motor side when the energization to the magnetic coil 35 is stopped. The frame member 12 is constituted of ferromagnetic substances, such as iron, and forms a part of the magnetic path together with the fixed yoke 36.

Figure 6:
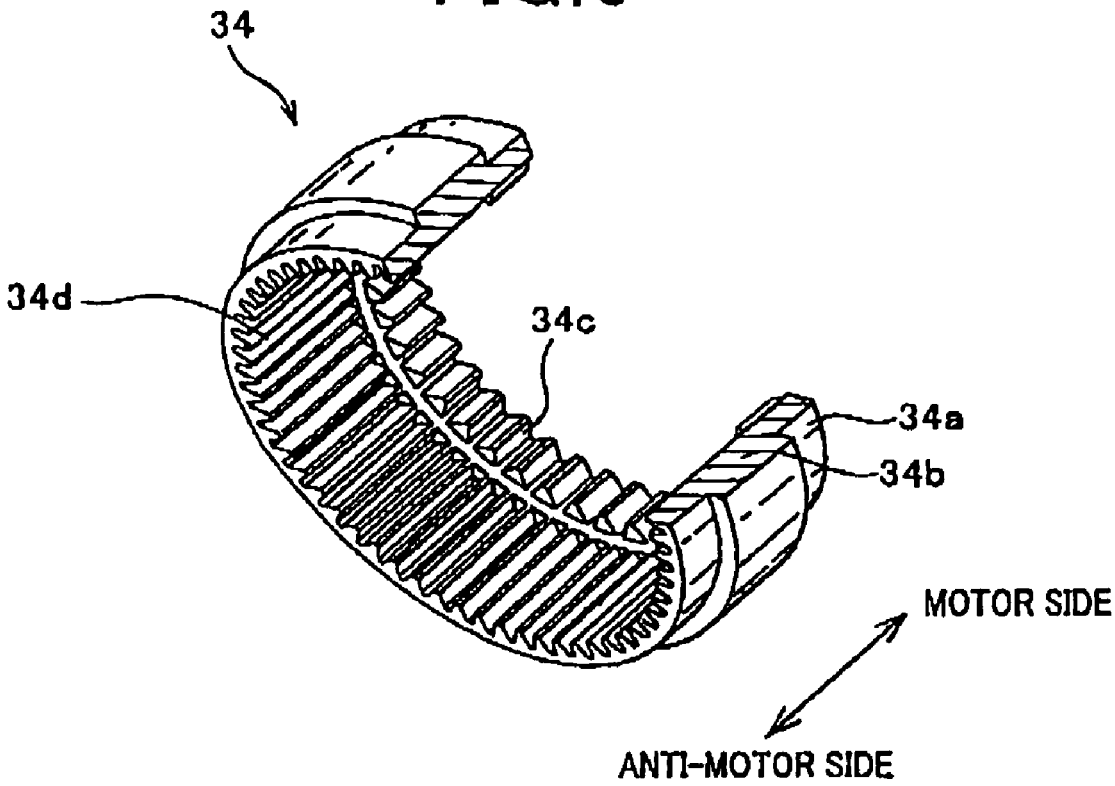
FIG. 6 is a perspective diagram of an engaging part.

The engaging part 34 is made of a ferromagnetic substance (for example, iron) magnetized by the electromagnet. The engaging part 34 has a ring shape arranged coaxially on the perimeter of two internal gears 25 and 29. The perimeter of the engaging part 34 fits into the inner circumference of the cylinder wall part 8*a* of the front housing 8 and its movement to the direction of the diameter is regulated (centering), however it is allowed to slide along the axis. As shown in FIG. 6, a rotation regulating part 34*a* having a small inner diameter is formed on the motor side of the engaging part 34. A cylinder iron core part 34*b* having a large inner diameter is formed on the anti-motor side of the rotation regulating part 34*a*. Pluralities of teeth parts 34*c* and 34*d* are formed in the inner circumference of the rotation regulating part 34*a*, and the inner circumference of the cylinder iron core part 34*b* at all circumferences, respectively.

Figure 3:
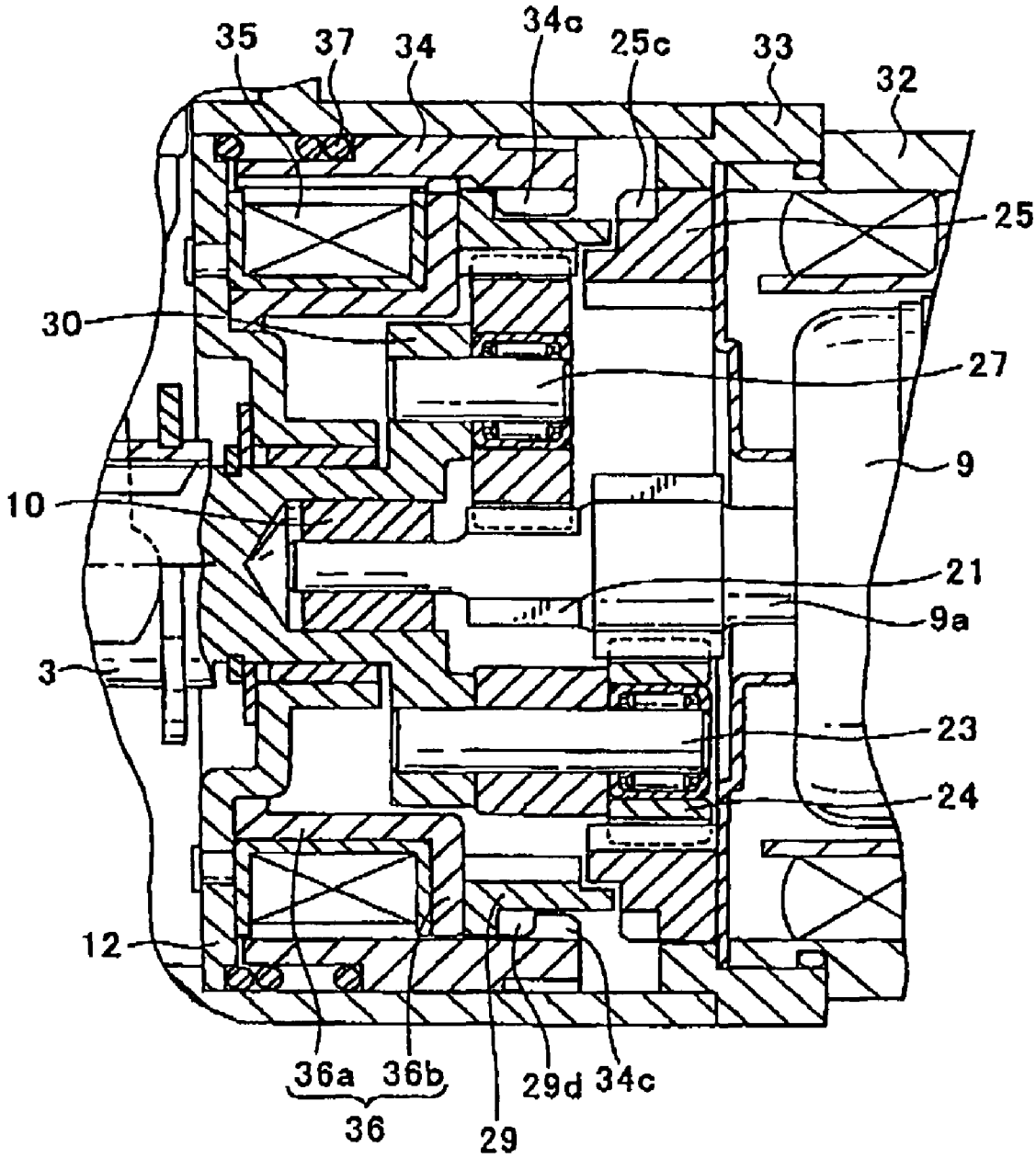
FIG. 3 is a sectional view of a speed reducer and a switching device (a coil is ON)

A motor side half of the teeth part 34*c* formed in the inner circumference of the rotation regulating part 34*a* engages to the teeth part 25*c* formed in the 1st internal gear 25 when the engaging part 34 has moved to the motor side, as shown in FIG. 2. An anti-motor side half of the teeth part 34*c* engages to the teeth part 29*d* formed in the 2nd internal gear 29 when the engaging part 34 has moved to the anti-motor side, as shown in FIG. 3. That is, the teeth part 34*c* formed in the rotation regulating part 34*a* is constituted by a 1st concavo-convex part and a 2nd concavo-convex part as a unit.

The length in the axis direction of the teeth part 34*c* formed in the rotation regulating part 34*a* is set to a little shorter than the distance in the axial direction of the space obtained between the teeth part 25*c* formed in the 1st internal gear 25 and the 2nd internal gear 29. That is, the teeth part 34*c* formed in rotation regulating part 34*a* never engages with the teeth part 25*c* formed in the 1st internal gear 25 and the teeth part 29*d* in the 2nd internal gear 29 at the same time. In addition, in order to have teeth engage smoothly, it is effective to form suitable chamfering to the both edges of the circumference of the teeth part 34*c* formed in the rotation regulating part 34*a*, teeth part 25*c* formed in the 1st internal gear 25, and the teeth part 29*d* formed in the 2nd internal gear 29, respectively.

As shown in FIG. 2, the magnetic coil 35 is wound onto a bobbin 38 made of resin, and is arranged at the anti-motor side of the 2nd internal gear 29. The magnetic coil 35 is fixed to the frame member 12 via a projected part 38*a* provided in the bobbin 38. An end of the magnetic coil 35 pulled out from the exterior of the starter 1 is connected to the energization control means (for example, ECU, not shown), and ON (energization) and OFF (stop energization) is switched by a signal from the energization control means.

The energization control means may detect the outside air temperature, for example, directly or indirectly, and switches the ON/OFF state of the magnetic coil 35 depending on the detected outside air temperature.

To be more specific, the energization control means switches the magnetic coil 35 OFF when the outside air temperature is above 0 degree centigrade, and switches the magnetic coil 350N when the outside air temperature is below 0 degree centigrade.

As shown in FIG. 2, the fixed yoke 36 is comprised of a cylindrical magnetic path part 36*a* that forms a magnetic path in the inner circumference of the magnetic coil 35, and a ring-like magnetic path part 36*b* that forms the magnetic path in the motor side of the magnetic coil 35. The anti-motor side edge part of the cylindrical magnetic path part 36*a* fits and is fixed unrotatably into the perimeter of a part with middle stage 12*a* provided in the frame member 12. The fixed yoke 36 is arranged so that its axis matches the axis of the armature shaft 9*a*.

Figure 7:
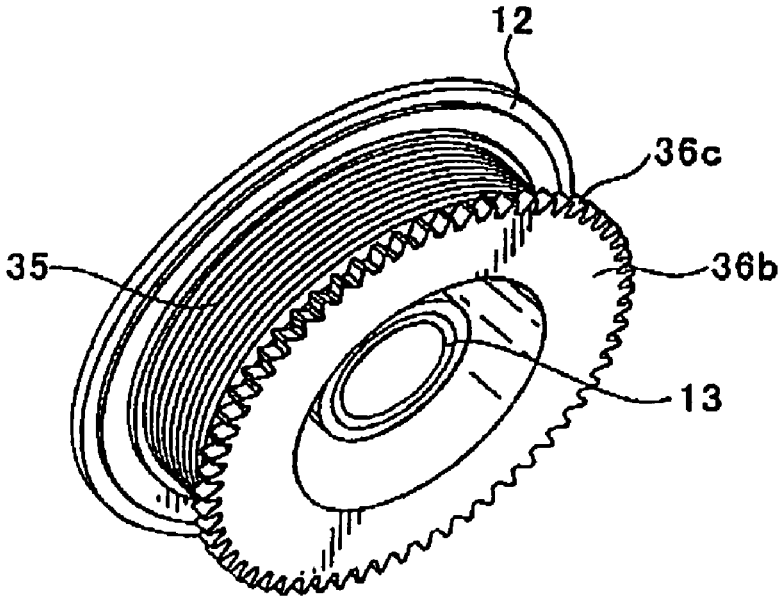
FIG. 7 is a perspective diagram of a coil unit.

As shown in FIG. 7, pluralities of teeth part 36*c* are formed in along all of the circumferences of the ring-like magnetic path part 36*b*. A teeth part 34*d* formed in the inner circumference of the cylinder iron core part 34*b* of the engaging part 34 engages to the teeth part 36*c* so that the ring-like magnetic path part 36*b* regulates the rotation of the engaging part 34 in the direction of a circumference. However, movement of the engaging part 34 in the direction of axis is permitted. FIG. 7 is the perspective diagram of the coil unit, which the magnetic coil 35 and the fixed yoke 36 are attached to the frame member 12.

The return spring 37 is arranged between the outer diameter part of the frame member 12 and a level difference formed in the perimeter of the engaging part 34. The return spring 37 pushes the engaging part 34 to the motor side. When the magnetic coil 35 is not energized, the engaging part 34 is pushed to the motor side by the force of the return spring 37, and the teeth part 34*c* formed in the rotation regulating part 34*a* of the engaging part 34 engages with the teeth part 25*c* formed in the 1st internal gear 25. At this time, the motor side end surface of the engaging part 34 contacts the joint member 33, and the engaging part 34 stands still, as shown in FIG. 2.

On the other hand, at the time the magnetic coil 35 is energized, the pushing force of the return spring 37 is resisted, and the engaging part 34 is attracted by the electromagnet. Then the teeth part 34*c* formed in the rotation regulating part 34*a* of the engaging part 34 engages with the teeth part 29*d* formed in the 2nd internal gear 29. At this time, the anti-motor side end surface of the engaging part 34 contacts the frame member 12, and the engaging part 34 stands still, as shown in FIG. 3.

Next, the operation of starter 1 is explained hereafter.

When the starting switch is closed, the switch coil of the electromagnetic switch 7 is energized and the plunger 15 is attracted therein. According to the movement of the plunger 15, the clutch 4 and the pinion gear 5 will be pushed out in the anti-motor direction (left of FIG. 1) on the output shaft 3 via the shift lever 6. By the movement of the plunger 15, the main point of contact closes thus the electric motor 2 is energizes from the battery, and the armature 9 starts rotating. The rotation of the armature 9 is slowed down by the 1st reduction ratio or the 2nd reduction ratio and transmitted to the output shaft 3. Further, the rotation of the armature 9 is transmitted from the output shaft 3 to the pinion gear 5 via the clutch 4. When the pinion gear 5 engages to the ring gear, the rotation is transmitted to the ring gear from the pinion gear 5, and it cranks the engine.

After the engine has started by cranking and the starting switch is opened, the energization to the switch coil will be stopped, and the attractive force of the electromagnet disappears. Consequently, the plunger 15 will be pushed back by the reactive force of the return spring 37 and the main point of contact opens and the energization to the electric motor 2 from a battery is stopped, thus rotation of the armature 9 slows down gradually and stops.

Furthermore, when the plunger 15 is pushed back, the clutch 4 is pushed back as well by the shift movement of the shift lever 6 that is an opposite direction for starting the engine. Thus the pinion gear 5 is disengaged from the ring gear, and then returns back to the predetermined position (the position shown in FIG. 1) together with the clutch 4 on the output shaft 3 and stops.

Next, the operation of the speed reducer is explained hereafter.

a) When the 1st Reduction Ratio is Selected.

Since the magnetic coil 35 is in the OFF state, and the teeth part 34*c* formed in the rotation regulating part 34*a* of the engaging part 34 and the teeth part 25*c* formed in the 1st internal gear 25 are engaged, the rotation of the 1st internal gear 25 is regulated and rotation of the 2nd internal gear 29 is permitted (refer to FIG. 2). Therefore, the rotation generated in the armature 9 is transmitted to the 1st planet gear 24 from the 1st sun gear 20, and while the 1st planet gear 24 rotates, it revolves the circumference of the 1st sun gear 20. On the other hand, since the rotation of the 2nd internal gear 29 is not regulated (rotation is permitted), the 2nd planet gear 28 only rotates according to the rotation of the 2nd sun gear 21, and does not revolve around the 1st sun gear 20.

Thereby, the revolution of the 1st planet gear 24 is transmitted to the output shaft 3 from the planet carrier 30. That is, the rotation of the armature 9 is slowed down by the 1st reduction ratio, and is transmitted to the output shaft 3.

b) When the 2nd Reduction Ratio is Selected.

When the magnetic coil 35 is turned ON by the signal from the energization control means, the engaging part 34 will be attracted by the electromagnet, and will move to the anti-motor side resisting the elastic force of the return spring 37. Consequently, the engagement of the teeth part 34*c* formed in the rotation regulating part 34*a* and the teeth part 25*c* formed in the 1st internal gear 25 is canceled, and the engagement of the teeth part 34*c* formed in the rotation regulating part 34*a* and the teeth part 29*d* formed in the 2nd internal gear 29 is performed. At this time, when the teeth part 34*c* and the teeth part 29*d* are in the engageable position, in other words, when the teeth part 34*c* (convex part) formed in the rotation regulating part 34*a* is located between the teeth part 29*d* and the adjoined teeth part 29*d* (concave part) formed in the 2nd internal gear 29, then the teeth part 34*c* formed in the rotation regulating part 34*a* enters between the teeth part 29*d* and the adjoined teeth part 29*d* formed in the 2nd internal gear 29, and engagement of the both is completed. Thereby, the rotation of the 2nd internal gear 29 is regulated and rotation of the 1st internal gear 25 is permitted (refer to FIG. 3).

On the other hand, when the engaging part 34 is attracted to the anti-motor side by the electromagnet, and when the end surface of the teeth part 34*c* formed in the rotation regulating part 34*a* and the end surface of the teeth part 29*d* formed in the 2nd internal gear 29 contact in the direction of the axle, the 2nd internal gear 29 rotates slowly with the rotation of the armature 9 according to the 2nd gear ratio with the sun gear 21. Consequently, the position of the teeth part 29*d* shifts in the direction of the circumference due to the attracting force of the electromagnet. The attracting force acts between the end surface of the teeth part 34*c* formed in the rotation regulating part 34*a* and the end surface of the teeth part 29*d* formed in the 2nd internal gear 29. Thus the both of the teeth parts can engage when the teeth part 29*d* rotates to the position where the teeth part 34*c* can engage.

After the rotation of the 2nd internal gear 29 has been regulated by the engaging part 34, if rotation occurs in the armature 9 by closing the starting switch, the rotation of the armature 9 is transmitted to the 2nd planet gear 28 from the 2nd sun gear 21, and the 2nd planet gear 28 rotates and revolve around the circumference of 2nd sun gear 21. On the other hand, since the rotation of the 1st internal gear 25 is not regulated (rotation is permitted), the 1st planet gear 24 only rotates according to the rotation of the 1st sun gear 20, and does not revolve around the 1st sun gear 20.

Thereby, revolution of the 2nd planet gear 28 is transmitted to the output shaft 3 from the planet carrier 30. That is, the rotation of the armature 9 is slowed down by the 2nd reduction ratio, and is transmitted to the output shaft 3.

When the magnetic coil 35 is turned OFF by the signal from the energization control means after the engine has started, the attracting force of the electromagnet to the engaging part 34 will disappears, and will move to the motor side by the elastic force of the return spring 37. Consequently, the engagement of the teeth part 34*c* formed in the rotation regulating part 34*a* and the teeth part 29*d* formed in the 2nd internal gear 29 is canceled, and the engagement of the teeth part 34*c* formed in the rotation regulating part 34*a* and the teeth part 25*c* formed in the 1st internal gear 25 is performed. At this time, when the teeth part 34*c* and the teeth part 25*c* are in the engageable position, in other words, when the teeth part 34*c* (convex part) formed in the rotation regulating part 34*a* is located between the teeth part 25*c* and the adjoined teeth part 25*c* (concave part) formed in the 1st internal gear 25, then the teeth part 34*c* formed in the rotation regulating part 34*a* enters between the teeth part 25*c* and the adjoined teeth part 25*c* formed in the 1st internal gear 25, and engagement of the both is completed. Thereby, the rotation of the 1st internal gear 25 is regulated and rotation of the 2nd internal gear 29 is permitted (refer to FIG. 2).

On the other hand, when the engaging part 34 is pushed back to the motor side, and when the end surface of the teeth part 34*c* formed in the rotation regulating part 34*a* and the end surface of the teeth part 25*c* formed in the 1st internal gear 25 contact in the direction of the axle, the state of the end surfaces of the teeth part 34*c* and the teeth part 25*c* being contacted is maintained in the state of the force of the return spring 37 is applied. When the armature 9 of the electric motor 2 rotates at the time of next engine starting in above state, the 1st internal gear 25 rotates slowly according to the gear ratio with the 1st sun gear 20, thus the position of the teeth part 25*c* formed in the 1st internal gear 25 shifts in the direction of a circumference, and both the teeth parts can be engaged when the teeth part 25*c* rotates to the position where it can engage the teeth part 34*c* formed in the rotation regulating part 34*a*. By this, the rotation of the 1st internal gear 25 is regulated, and the rotation of the 2nd internal gear 29 is permitted, thus starting the engine by the 1st reduction ratio becomes possible.

Figure 8:
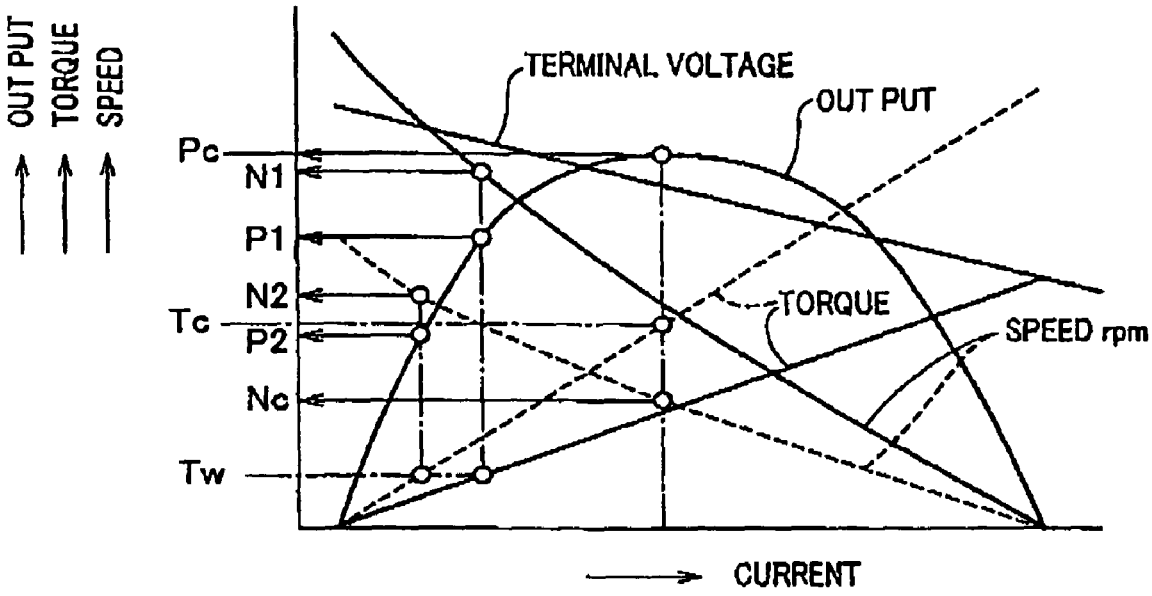
FIG. 8 is a characteristic graph of a starter.

Next, the characteristics of the starter 1 are explained hereafter with reference to FIG. 8.

The torque and speed at the time of using the 1st speed reducer (the 1st reduction ratio) are shown in FIG. 8 by a solid line, and the torque and speed at the time of using the 2nd speed reducer (the 2nd reduction ratio) are shown in dashed line.

First, when the torque of the operating point at normal temperatures (in general, 5 to 35 degrees centigrade) is shown by Tw, the output at the time of using the 1st reduction ratio is set to P1, and the speed is set to N1, while the output at the time of using the 2nd reduction ratio is set to P2, and the speed is set to N2. In the starter1 of this embodiment, since the 1st reduction ratio is used in temperature conditions higher than 0 degree centigrade, an output is set to P1, the speed is set to N1, the output and the speed improve sharply and shortening of starting time can be aimed compared to the case where the 2nd reduction ratio is used.

On the other hand, when the torque of the operating point in low temperature of minus 20 degrees centigrade or less is shown by Tc, the output by conventional single reduction ratio is Pc, and the speed is Nc. In the starter1 of this embodiment, since the 2nd reduction ratio is used in temperature conditions of 0 degree centigrade or less, the output becomes Pc, the speed becomes Nc, and it becomes the same operating point as conventional single reduction ratio. Thereby, the same good low-temperature starting nature as the former can be obtained.

THE EFFECT OF THE EMBODIMENT

The starter1 of this embodiment is being able to regulate reliably the rotation of the 1st internal gear 25 or the 2nd internal gear 29 by mechanical engagement (engagement of the teeth parts) to the engaging part 34. By moving the engaging part 34 in the direction of the axis, the starter1 is also being able to change the reduction ratio by switching the internal gears 25 and 29 that regulate the rotation. According to this composition, since regulating and canceling the regulation of the rotation of the two internal gears 25 and 29 can be performed in one engaging part 34, the number of parts can be reduced and the structure can be simplified. Further, the composition is to move the engaging part 34 in the direction of the axis for regulating and canceling the regulation of the rotation of the two internal gears 25 and 29, it is not necessary to move the engaging part 34 radially, thus radial enlargement can be controlled.

When concavo-convex parts are formed in the perimeter of the two internal gears 25 and 29 on the opposite side in the direction of the axle, respectively, for example, specifically, if concavo-convex parts are formed in the perimeter of the 1st internal gear 25 on the direction of the motor side and in the perimeter of the 2nd internal gear 29 on the direction of the anti-motor side, respectively, it is necessary to detach and form the 1st concavo-convex part and the 2nd concavo-convex part in the direction of the axis on the engaging part 34. That is, in order to form the 1st concavo-convex part and the 2nd concavo-convex part on both sides of the axis ranging over two internal gears 25 and 29, the length in the direction of the axis of the engaging part 34 becomes long.

On the other hand, in the present invention, since concavo-convex parts are formed in the perimeter of the 1st internal gear 25 and the 2nd internal gear 29 that face each other in the direction of the axis, respectively, the 1st concavo-convex part and the 2nd concavo-convex part can be formed closely in the direction of the axis, and it is possible to shorten the length in the direction of the axis of the engaging part 34.

Two internal gears 25 and 29 are arranged adjoining in the direction of the axis, and since the end surfaces of both internal gears 25 and 29 facing each other in the direction of the axis are engaged rotatably in concavo-convex manner, the axes of the both internal gears 25 and 29 can be matched. Therefore, it is possible to control the inclination of the centers of the two internal gears 25 and 29, and to smoothly change the two internal gears 25 and 29 by the engaging part 34.

In addition, since one of the two internal gears 25 or 29 races because the engagement to the engaging part 34 is canceled, it is possible to use a low-mass resin material (polyamide resin, for example) for at least one of the internal gears, thus unbalancing influence that occurs to the racing internal gear can be reduced, thus there will be an effect that can control the vibration.

Although the magnetic coil 35 is used for the driving means of the engaging part 34 in this embodiment, the rotation of the internal gears 25 and 29 can be regulated by a mechanical engagement of the engaging part 34 without depending on the power of attracting force of the magnetic coil 35, therefore the magnetic coil 35 can be miniaturized. That is, the magnetic force generated by the magnetic coil 35 is needed only to attract the engaging part 34 in the direction of axis (the anti-motor direction), thus it is not necessary to regulate the rotation of the internal gears 25 and 29 by the attracting force of the magnetic coil 35, therefore the magnetic coil 35 can be miniaturized.

Moreover, the starter 1 being enlarged in the direction of the diameter is avoidable by arranging the miniaturized magnetic coil 35 adjoining to the 2nd internal gear 29 it in the direction of the axis.

The rotation of the engaging part 34 is regulated in the direction of the circumference by engaging the teeth part 34*d* formed in the inner circumference of the cylinder iron core part 34*b* to the teeth part 36*c* formed in the perimeter of the ring-like magnetic path part 36*b* of the fixed yoke 36. In this case, it is not necessary to newly provide any parts other than the fixed yoke 36 in order to regulate the rotation of the engaging part 34, thus the increase in parts number can be controlled.

Further, the facing areas of inner side of the cylinder iron core part 34*b* and the perimeter side of the ring-like magnetic path part 36*b* becomes large by forming the teeth parts 34*d* and 36*c* in the inner circumference of the cylinder iron core part 34*b* and the inner circumference of the ring-like magnetic path part 36*b* that face each other in the direction of the diameter, respectively, thus the magnetic resistance decreases and the attracting force of the magnetic coil 35 can be improved.

Furthermore, since the ON/OFF state of the magnetic coil 35 is selected according to the out side temperature in this embodiment, when out side air temperature is higher than 0 degree centigrade, the magnetic coil 35 is turned OFF and a small reduction ratio of the 1st reduction ratio is selected, for example, it is possible to shorten the engine starting time by increased speed of the starter 1 instead of selecting the 2nd reduction ratio. On the other hand, when the out side air temperature is 0 degree centigrade or less, it is possible to secure a good engine starting nature by selecting the a large reduction ratio of the 2nd reduction ratio even if the engine friction becomes large by the fall of out side air temperature.

Moreover, if the 1st reduction ratio is selected when the out side air temperature is higher than 0 degree centigrade, the frequency of using the 1st reduction ratio will increase rather than the 2nd reduction ratio in many areas on the earth, such as Japan, United states and Europe, for example. For this reason, the electric energy needed to energize the magnetic coil 35 can be controlled to the minimum by turning OFF the magnetic coil 35 when selecting the frequently used 1st reduction ratio.

What is claimed is:

1. A reduction-gear starter for an engine, comprising:

an electric motor having an armature shaft;

a set of planetary speed reducers having a different reduction ratios disposed on the armature shaft side-by-side, wherein one of the speed reducers is selected in order to reduce a revolving speed of the motor;

a pair of internal gears used in the set of planetary speed reducers;

an engaging part arranged coaxially on a perimeter of the pair of internal gears, wherein the engaging part is arranged unrotatably to a fixed member inside the starter and arranged movably along a direction of an axis, and engages mechanically to one of the internal gears in order to regulate the rotation of the internal gear;

a $1^{st}$ teeth part formed on the perimeter of a $1^{st}$ internal gear of the pair of internal gears, the first teeth part being arranged on a side opposite the motor;

a 2nd teeth part formed on the perimeter of a 2nd internal gear of the pair of internal gears, the second teeth part being arranged on a side toward the motor;

a 3rd teeth part formed in an inner circumference of the engaging part and engageable with the 1st teeth part formed in the 1st internal gear; and a 4th teeth part formed in the inner circumference of the engaging part and engageable with the 2nd teeth part formed in the 2nd internal gear;

wherein the reduction ratio is selected by switching the internal gears by moving the engaging part along the direction of the axis, the rotation of the 1st internal gear is regulated when the 3rd teeth part engages with the 1st teeth part of the 1st internal gear by moving the engaging part toward the motor, and the rotation of the 2nd internal gear is regulated when the 4th teeth part engages with the 2nd teeth part of the 2nd internal gear by moving the engaging part away from the motor.

2. The reduction-gear starter of claim 1, wherein the 3rd teeth part and the 4th teeth part are arranged as a unit in the direction of the axis.

3. The reduction-gear starter of claim 1, wherein an end surface of one of the pair of internal gears facing each other in the direction of the axis is fit rotatably inside an end surface of another one of the pair of internal gears.

4. The reduction-gear starter of claim 1, wherein resin material is used for at least one of the internal gears.

5. The reduction-gear starter of claim 1, further comprising:

a magnetic coil that forms an electromagnet by energization and drives the engaging part to one direction by the magnetic force of the electromagnet; and a return spring that pushes back the engaging part to another direction when the energization to the magnetic coil is stopped;

wherein the magnetic coil is arranged on either a side of the first internal gear toward the motor, or a side of the second internal gear opposite the motor.

6. The reduction-gear starter of claim 5, wherein a ferromagnetic substance attracted by the electromagnet constitutes the engaging part.

7. The reduction-gear starter of claim 5, further comprising:

a fixed yoke that lets magnetic flux generated by the magnetic coil pass through, wherein the fixed yoke has an annular magnetic path part that is arranged between the magnetic coil and one of the pair of the internal gears; and the engaging part having a cylinder iron core part that is extended in the direction of an axle on the perimeter of the annular magnetic path part;

wherein an inner circumference of the cylinder iron core part engages via teeth to the annular magnetic path part so that the rotation in the direction of a circumference of the engaging part is regulated, while a movement in the direction of axis is permitted.

8. The reduction-gear starter of claim 5, wherein the engaging part regulates the rotation of the internal gear used for one of the speed reducers, which has a low reduction ratio, when the magnetic coil is not energized, and the engaging part regulates the rotation of the internal gear used for another one of the speed reducers, which has a high reduction ratio, when the magnetic coil is energized.

9. The reduction-gear starter of claim 5, wherein the engaging part regulates the rotation of one of the internal gears, which is used for a frequently used one of the speed reducers, when the magnetic coil is not energized, and the engaging part regulates the rotation of another one of the internal gears, which is used for a not frequently used one of the speed reducers, when the magnetic coil is energized.

10. The reduction-gear starter of claim 8, wherein the magnetic coil is not energized when an outside air temperature is higher than 0 degree centigrade, and the magnetic coil is energized when the outside air temperature is 0 degree centigrade or less.

* * * * *